US009104128B2

(12) United States Patent
Kashimoto et al.

(10) Patent No.: US 9,104,128 B2
(45) Date of Patent: Aug. 11, 2015

(54) IMAGE FORMING APPARATUS

(71) Applicant: KYOCERA Document Solutions Inc., Osaka (JP)

(72) Inventors: Masahiro Kashimoto, Osaka (JP); Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/257,835

(22) Filed: Apr. 21, 2014

(65) Prior Publication Data

US 2014/0348543 A1 Nov. 27, 2014

(30) Foreign Application Priority Data

May 23, 2013 (JP) ..... 2013-109231

(51) Int. Cl.

| | |
|---|---|
| ***G03G 15/00*** | (2006.01) |
| ***G03G 15/01*** | (2006.01) |
| ***G03G 15/09*** | (2006.01) |
| ***G03G 15/08*** | (2006.01) |

(52) U.S. Cl.

CPC ..... *G03G 15/0121* (2013.01); *G03G 15/0808* (2013.01); *G03G 15/0889* (2013.01); *G03G 15/09* (2013.01)

(58) Field of Classification Search

CPC ..... G03G 15/0877; G03G 15/0813; G03G 15/09; G03G 21/1676

USPC ..... 399/110, 119, 120, 257

See application file for complete search history.

(56) References Cited

U.S. PATENT DOCUMENTS

| | | | | |
|---|---|---|---|---|
| 2007/0269235 | A1 | 11/2007 | Hirose | 399/254 |
| 2009/0175659 | A1* | 7/2009 | Sheen | 399/256 |
| 2009/0317141 | A1 | 12/2009 | Okazaki et al. | 399/254 |

FOREIGN PATENT DOCUMENTS

| | | | |
|---|---|---|---|
| JP | 2007-334288 | A | 12/2007 |
| JP | 2010-2589 | A | 1/2010 |

* cited by examiner

*Primary Examiner* — Walter L Lindsay, Jr.
*Assistant Examiner* — Jessica L Eley
(74) *Attorney, Agent, or Firm* — Stein IP, LLC

(57) ABSTRACT

An image forming apparatus includes an image forming section including an image carrier and a developing device, and a developer recovery mechanism. The developing device includes, a developer carrier, and a developer discharge portion. The image forming section incorporates a developing device employing a first developing method where toner is caused to adhere to the image carrier by a magnetic brush formed on the developer carrier, or a developing device having a toner carrier between the developer carrier and the image carrier, and employing a second developing method where a toner layer is formed on the toner carrier by a magnetic brush formed on the developer carrier, and toner is caused to adhere to the image carrier by the toner layer formed on the toner. These developing devices, in the image forming section, each have a same positional relationship between the developer discharge portion and an image-carrier rotation shaft.

6 Claims, 8 Drawing Sheets

IMAGE FORMING APPARATUS

CROSS-REFERENCE TO RELATED APPLICATIONS

This application is based upon and claims the benefit of priority from the corresponding Japanese Patent Application No. 2013-109231, filed on May 23, 2013, in the Japanese Patent Office. All disclosures of the document(s) named above are incorporated herein by reference.

BACKGROUND OF THE INVENTION

The present disclosure relates to an image forming apparatus such as a copier, a printer, and a facsimile machine, and relates particularly to an image forming apparatus capable of compatibly incorporating two kinds of developing devices employing different developing methods.

The following methods are included in conventionally known developing methods involving use of dry toner and employed in an image forming apparatus using electrophotographic process: a one-component developing method in which no carrier is used, and a two-component developing method (hereinafter also referred to as a first developing method) in which a two-component developer including a magnetic carrier (hereinafter also referred to simply as carrier) and non-magnetic toner that is electrostatically charged by the magnetic carrier is used to develop an electrostatic latent image on a photosensitive body by using a magnetic brush of the toner and the carrier formed on a magnetic roller.

Further, in cases of color printing, where color superimposition is performed, color toner having transparency needs to be used, and thus the color toner is required to be non-magnetic toner. For this reason, full-color image forming apparatuses often adopt the two-component developing method where toner is conveyed and electrically charged by using a carrier.

On the other hand, there has been proposed a developing method (hereinafter referred to also as a second developing method) where, when a developer is transferred, by using a magnetic roller (a developer carrier), onto a developing roller (a toner carrier) disposed out of contact with an image carrier (a photosensitive body), non-magnetic toner alone is transferred onto the developing roller to form a thin toner layer thereon, with a magnetic carrier left on the magnetic roller, and the toner is caused to adhere to an electrostatic latent image on the image carrier (the photosensitive body) by an alternating-current electric field.

There has been also proposed a developing device where a developer including a carrier is supplied into a developing container and surplus part of the developer is discharged, to thereby reduce degradation of the charging performance. A known example of such a developing device is one that is provided with supply means that performs additional supply of a developer via a supply port formed in a developing container, and a developer discharging mechanism that discharges the surplus part of the developer to outside the developing container.

SUMMARY OF THE INVENTION

According to one aspect of the present disclosure, an image forming apparatus includes an image forming section that includes an image carrier and a developing device, and a developer recovery mechanism. On the image carrier, an electrostatic latent image is formed. The developing device is provided corresponding to the image carrier, has a developing container for accommodating a two-component developer including magnetic carrier and toner, a developer carrier rotatably supported in the developing container, an agitation member that agitates and conveys the developer in the developing container, a supply member that agitates and conveys the developer received from the agitation member and supplies the developer to the developer carrier, a developer supply port through which the developer is supplied into the developing container, and a developer discharge portion that discharges surplus part of the developer out of the developing container. The developing device develops the electrostatic latent image formed on the image carrier. The developer recovery mechanism has a connection portion connected to the developer discharge portion, and recovers the surplus part of the developer discharged from the developing device. The image forming section is capable of selectively incorporating either one of: a developing device employing a first developing method where toner is caused to adhere to a surface of the image carrier by means of a magnetic brush formed on the developer carrier; and a developing device that has a toner carrier disposed between the developer carrier and the image carrier, and that employs a second developing method where a toner layer is formed on a surface of the toner carrier by means of a magnetic brush formed on the developer carrier and toner is caused to adhere to the surface of the image carrier. by means of the toner layer formed on the toner carrier. The developing device employing the first developing method and the developing device employing the second developing method, in a state of being installed in the image forming device, have a same positional relationship of the developer discharge portion with respect to a rotation shaft of the image carrier.

Still other objects and specific advantages of the present disclosure will become apparent from the following descriptions of preferred embodiments.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
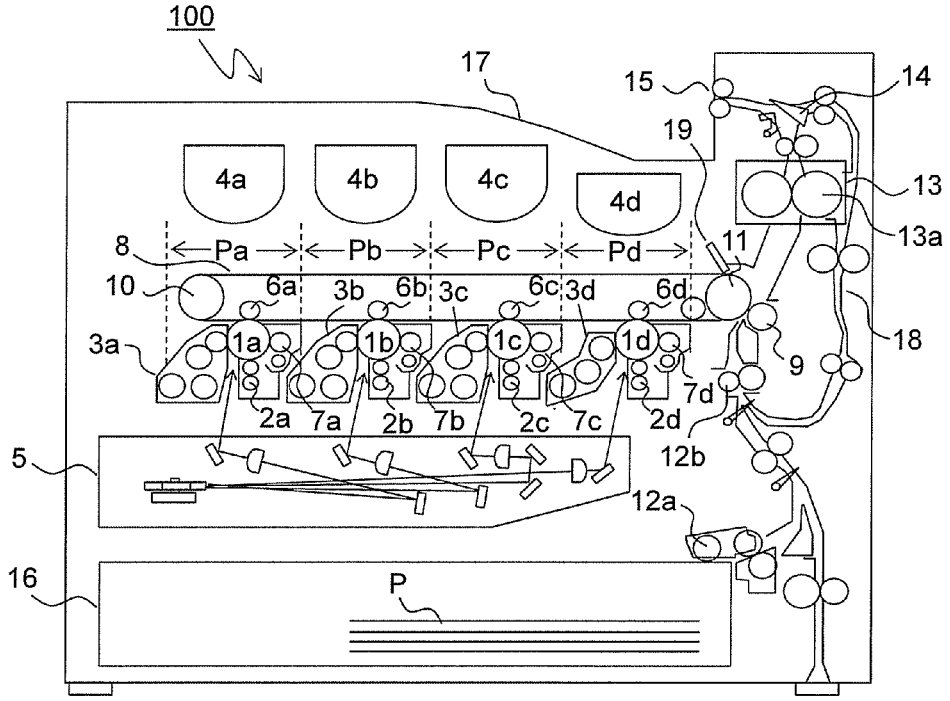
FIG. 1 is a schematic sectional view showing an interior configuration of an image forming apparatus 100 according to a first embodiment of the present disclosure.

Hereinafter, embodiments of the present disclosure will be described with reference to the accompanying drawings. FIG. 1 is a sectional view showing a schematic configuration of an image forming apparatus 100 according to a first embodiment of the present disclosure. The image forming apparatus 100 of the present embodiment is a quadruple tandem type color printer operable to perform image formation with four photosensitive drums 1*a*, 1*b*, 1*c*, and 1*d* corresponding to 4 different colors (magenta, cyan, yellow, and black) and arranged parallel to each other.

In an apparatus main body of the image forming apparatus 100, four image forming sections Pa, Pb, Pc, and Pd are arranged in order from the left side in FIG. 1. These image forming sections Pa to Pd are provided corresponding to images of four different colors (magenta, cyan, yellow, and black, respectively), and the image forming sections Pa to Pd sequentially form magenta, cyan, yellow, and black images through steps of charging, exposing, developing, and transferring.

These image forming sections Pa to Pd are provided with photosensitive drums 1*a* to 1*d*, respectively, to carry visible images (toner images) of corresponding colors, and further, an intermediate transfer belt 8 that rotates in a counterclockwise direction in FIG. 1 is arranged in contact with the image forming sections Pa to Pd. The toner images formed on these photosensitive drums 1*a* to 1*d* are transferred one after another onto the intermediate transfer belt 8 moving in contact with the photosensitive drums 1*a* to 1*d*, and the thus transferred toner images are then transferred all at once onto paper P (recording medium) at a secondary transfer roller 9, and further, the toner images on paper P are fixed thereon at a fixing device 13, and then paper P is ejected to outside the image forming apparatus 100. The image forming process is performed on each of the photosensitive drums 1*a* to 1*d* while the photosensitive drums la to 1*d* are being made to rotate in a clockwise direction in FIG. 1.

The paper P onto which the toner images are transferred is accommodated in the paper cassette 16 disposed at a lower portion inside the image forming apparatus 100, and is conveyed to the secondary transfer roller 9 via a paper feeding roller 12*a* and a regist roller pair 12*b*. A dielectric plastic sheet is used as the intermediate transfer belt 8, which is typically formed as a jointless (seamless) belt. The intermediate transfer belt 8 and the secondary transfer roller 9 are driven to rotate by a belt driving motor (not shown) at the same linear velocity as the photosensitive drums 1*a* to 1*d*. For the purpose of removing toner and the like remaining on a surface of the intermediate transfer belt 8, a belt cleaner 19 is disposed downstream from the secondary transfer roller 9. The belt cleaner 19 is a blade-like member.

Next, the image forming sections Pa to Pd will be described. Around and below the rotatably disposed photosensitive drums 1*a* to 1*d*, the following are provided: charging devices 2*a*, 2*b*, 2*c*, and 2*d* that charge the photosensitive drums 1*a*. 1*b*, 1*c*, and 1*d*, respectively; an exposure unit 5 that performs exposure on each of the photosensitive drums 1*a* to 1*d* based on image data; developing devices 3*a*, 3*b*, 3*c*, and 3*d* that develop, using toner, electrostatic latent images formed on the photosensitive drums 1*a*, 1*b*, 1*c*, and 1*d*, respectively; and cleaning devices 7*a*, 7*b*, 7*c*, and 7*d* that recover and remove a developer (toner) remaining on the photosensitive drums 1*a*, 1*b*, 1*c*, and 1*d*, respectively, after the toner images on the photosensitive drums 1*a* to 1*d* are transferred.

On receipt of image data from a host device such as a personal computer, first, the charging devices 2*a* to 2*d* uniformly charge the surfaces of the photosensitive drums 1*a* to 1*d*, respectively. Subsequently, based on the image data, the exposure unit 5 irradiates the photosensitive drums 1*a* to 1*d* with light to thereby form electrostatic latent images on the photosensitive drums 1*a* to 1*d* according to the image data. The developing devices 3*a* to 3*d* are provided with developing rollers (developer carriers) that are located to respectively face the photosensitive drums 1*a* to 1*d*. The developing rollers are each filled with a predetermined amount of two-component developer including toner of a respective color, that is, magenta, cyan, yellow, or black.

Note that, in a case where the proportion of toner in the two-component developers accommodated in the respective developing devices 3*a* to 3*d* falls below a set value after toner images are formed as described later, developers including toner are supplied to the developing devices 3*a* to 3*d* from containers 4*a* to 4*d*, respectively. The toner within each of the developers is supplied onto a corresponding one of the photosensitive drums 1*a* to 1*d* by the developing devices 3*a* to 3*d*, respectively, and electrostatically adheres thereto. Thereby, toner images are formed according to the electrostatic latent images formed by the exposure performed by the exposure unit 5.

Then, a predetermined transfer voltage is applied across primary transfer rollers 6*a* to 6*d* and the photosensitive drums 1*a* to 1*d* by the primary transfer rollers 6*a* to 6*d*, respectively, and thereby, the magenta, cyan, yellow, and black toner images formed on the photosensitive drums 1*a* to 1*d* are primarily transferred onto the intermediate transfer belt 8. The toner images of the four colors are formed to have a predetermined positional relationship therebetween that is previously determined for forming a predetermined full-color image. The primary transfer rollers 6*a* to 6*d* are driven to rotate by a primary transfer drive motor (not shown) at the same linear velocity as the photosensitive drums 1*a* to 1*d* and the intermediate transfer belt 8. Thereafter, in preparation for formation of new electrostatic latent images to be subsequently performed, the toner and the like remaining on the surfaces of the photosensitive drums 1*a* to 1*d* after the primary transfer are removed by the cleaning devices 7*a* to 7*d*, respectively.

The intermediate transfer belt 8 is wound around and between a driven roller 10 and a driving roller 11. When the intermediate transfer belt 8 starts to rotate counterclockwise in conjunction with rotation of the driving roller 11 caused by the above-mentioned belt driving motor, a sheet of paper P is conveyed from the regist roller pair 12*b* at a predetermined timing to a nip portion (a secondary transfer nip portion) between the intermediate transfer belt 8 and the secondary transfer roller 9 disposed adjacent to the intermediate transfer belt 8. At the nip portion, the full-color image is transferred onto the sheet of paper P. The sheet of paper P onto which the toner image has been transferred is conveyed to the fixing device 13.

At the fixing device 13, heat and pressure are applied to the sheet of paper P when it passes through a nip portion (fixing nip portion) of a fixing roller pair 13*a* to fix the toner image on a side of the sheet of paper P, and thereby, the predetermined full-color image is formed. The sheet of paper P on which the full-color image has been formed is directed toward one of a plurality of conveying directions branched from a branching portion 14. In a case of forming an image only on one side of the sheet of paper P, the sheet of paper P is ejected as it is onto an ejection tray 17 by an ejection roller pair 15.

On the other hand, in a case of forming an image on each side of the sheet of paper P, the sheet of paper P that passed through the fixing portion 13 is conveyed such that part thereof temporarily projects to outside the apparatus from the ejection roller pair 15. Thereafter, the ejection roller pair 15 is caused to rotate reversely to thereby direct the sheet of paper P into a reverse conveying path 18 from the branching portion 14, and is conveyed back to the secondary transfer roller 9 with the image side reversed. Then, a next image formed on the intermediate transfer belt 8 is transferred by the secondary transfer roller 9 onto the unprinted side of the sheet of paper P, and then, after the sheet of paper P is conveyed to the fixing device 13, where the toner image is fixed on the sheet of paper P, the sheet of paper P is ejected by the ejection roller pair 15 onto the ejection tray 17.

Figure 2:
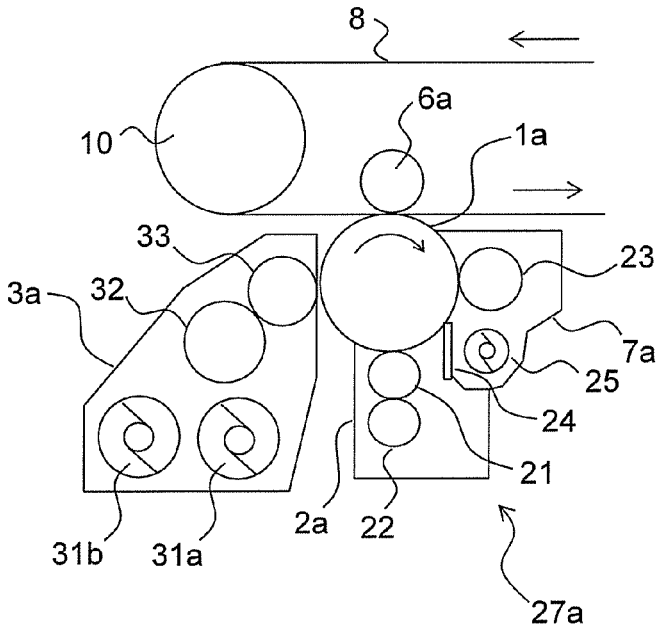
FIG. 2 is an enlarged sectional view showing the vicinity of an image forming section Pa in FIG. 1.
Figure 3:
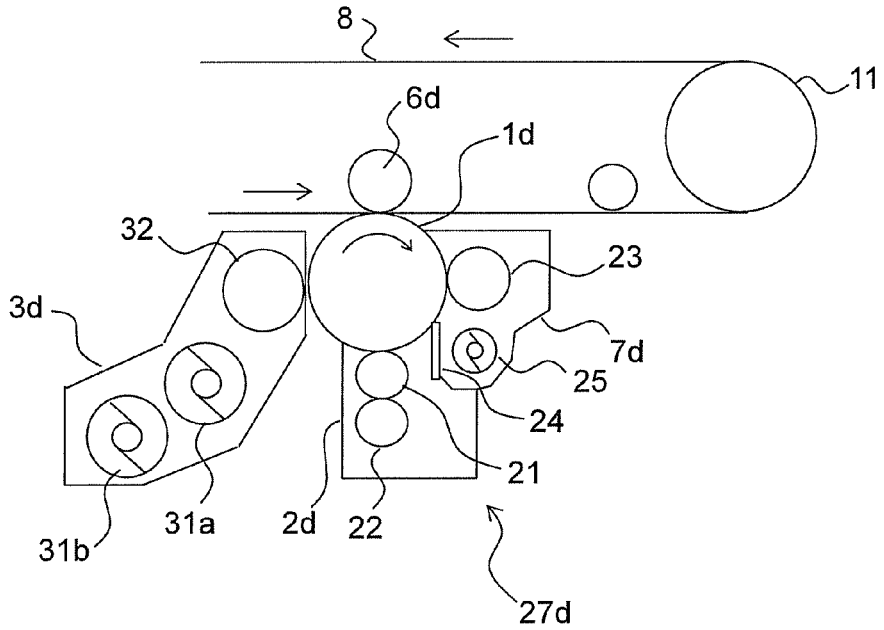
FIG. 3 is an enlarged sectional view showing the vicinity of an image forming section Pd in FIG. 1.

Next, details of the above image forming sections Pa to Pd will be described. FIG. 2 and FIG. 3 are sectional views showing in an enlarged manner the vicinity of the image forming sections Pa and Pd, respectively, shown in FIG. 1. Note that detailed descriptions will be omitted of the image forming sections Pb and Pc, which are basically similar to the image forming section Pa in configuration. Around the photosensitive drums 1*a* to 1*d*, along a drum rotation direction (clockwise direction in FIGS. 2 and 3), the above-mentioned charging devices 2*a* to 2*d*, developing devices 3*a* to 3*d*, primary transfer rollers 6*a* to 6*d*, and cleaning devices 7*a* to 7*d*, respectively, are arranged. Among these, the primary transfer rollers 6*a* to 6*d* are respectively disposed to face the photosensitive drums 1*a* to 1*d*, respectively, with the intermediate transfer belt 8 therebetween.

Further, the photosensitive drums 1*a* to 1*d*, the charging devices 2*a* to 2*d*, and the cleaning devices 7*a* to 7*d*, respectively, are built as units. Note that, in the image forming sections Pa to Pd, units including the photosensitive drums 1*a* to 1*d*, the charging devices 2*a* to 2*d*, the cleaning devices 7*a* to 7*d*, respectively, will be hereinafter referred to as drum units 27*a* to 27*d*.

The charging devices 2*a* to 2*d* have charging rollers 21 that are in contact with the photosensitive drums 1*a* to 1*d* to apply a charging bias to surfaces thereof, and charge cleaning rollers 22 for cleaning the charging rollers 21.

The cleaning devices 7*a* to 7*d* each have a rubbing roller (polishing member) 23, a cleaning blade 24, and a recovery spiral 25. For example, the rubbing roller 23 of the drum unit 27*a* is pressed against the photosensitive drum 1*a* with a predetermined pressure, and is driven by a drum cleaning motor (not shown) to rotate in the same direction as the photosensitive drum 1*a* at a contact surface where the rubbing roller 23 is in contact with the photosensitive drum 1*a*, but the linear velocity of the rubbing roller 23 is controlled to be greater (here, 1.2 times greater) than that of the photosensitive drum 1*a*. An example of the structure of the rubbing rollers 23 is one in which a foam layer of an ethylene-propylene terpolymer (EPDM) rubber having an Asker C hardness of 55 degrees is formed as a roller body around a metal shaft. The material for the roller body is not limited to the EPDM rubber, and the roller body may be formed of a rubber of another material or a foamed rubber body, and a material having an Asker C hardness from 10 to 90 degrees is preferably used.

Here, the Asker C is one of the durometers (spring type hardness meter) specified in the Standard of the Society of Rubber Industry, Japan, and it is an instrument for measuring hardness. The Asker C hardness refers to hardness measured with the above-mentioned measuring instrument, and a harder material has a larger value of the Asker C hardness.

The cleaning blades 24 are fixed to be in contact with the surfaces of the photosensitive drums 1*a* to 1*d* at locations downstream from where the rubbing rollers 23 are in contact with the photosensitive drums 1*a* to 1*d*. As the cleaning blade 24, for example, a polyurethane-rubber blade having a JIS hardness of 78 degrees is used. The cleaning blades 24 are attached such that the cleaning blades 24 contact the photosensitive drums 1*a* to 1*d* at a predetermined angle with respect to tangential directions of the photosensitive drums 1*a* to 1*d*. Note that elements such as the material and the hardness of the cleaning blades 24, the size of the cleaning blades 24, how far the cleaning blades 24 sink into the photosensitive drums 1*a* to 1*d*, and with how much pressure the cleaning blades 24 are pressed against the photosensitive drums 1*a* to 1*d* are properly set according to the specifications of the photosensitive drums 1*a* to 1*d*. The JIS hardness refers to hardness specified in Japanese Industrial Standards (JIS).

Residual toner removed from the surfaces of the photosensitive drums 1*a* to 1*d* by the rubbing rollers 23 and the cleaning blades 24 is discharged to outside the cleaning devices 7*a* to 7*d* in conjunction with rotation of the recovery spirals 25. Examples of toner used in the present disclosure include toner whose particles have an abrasive agent selected from silica, titanium oxide, strontium titanate, alumina, and the like, embedded in the surfaces thereof such that the abrasive agent partially protrudes from the surfaces, and toner in which an abrasive agent is electrostatically attached on the surfaces of the toner particles.

By controlling the rubbing roller 23 to rotate at a speed different from the speed of the photosensitive drum 1*a*, the surface of the photosensitive drum 1*a* is polished by the residual toner including the abrasive agent, and moisture, corona products, and the like are removed from the drum surface, together with the residual toner, by the rubbing roller 23 and the cleaning blade 24.

The developing devices 3*a* to 3*d* develop electrostatic latent images formed on the photosensitive drums 1*a* to 1*d*, respectively, into toner images using the two-component developers (hereinafter also referred to simply as developers) each including toner and carrier.

Among the developing devices 3*a* to 3*d*, the developing device 3*d* disposed in the image forming section Pd has a supply conveyance screw 31*a*, an agitation conveyance screw 31*b*, and a magnetic roller 32 (developer carrier), and employs the first developing method in which the toner is caused to adhere to the surface of the photosensitive drum 1*d* by using a magnetic brush formed on the magnetic roller 32.

On the other hand, the developing devices 3*a* to 3*c* disposed in the image forming sections Pa to Pc, corresponding to magenta, cyan, and yellow, each have the supply conveyance screw 31*a*, the agitation conveyance screw 31*b*, the magnetic roller 32 (developer carrier), and a developing roller 33 (toner carrier), and employs the second developing method in which the toner is caused to fly onto the surfaces of the photosensitive drums 1*a* to 1*c* by applying to the developing roller 33 a development bias of the same polarity (plus) as the toner charge polarity.

Figure 4:
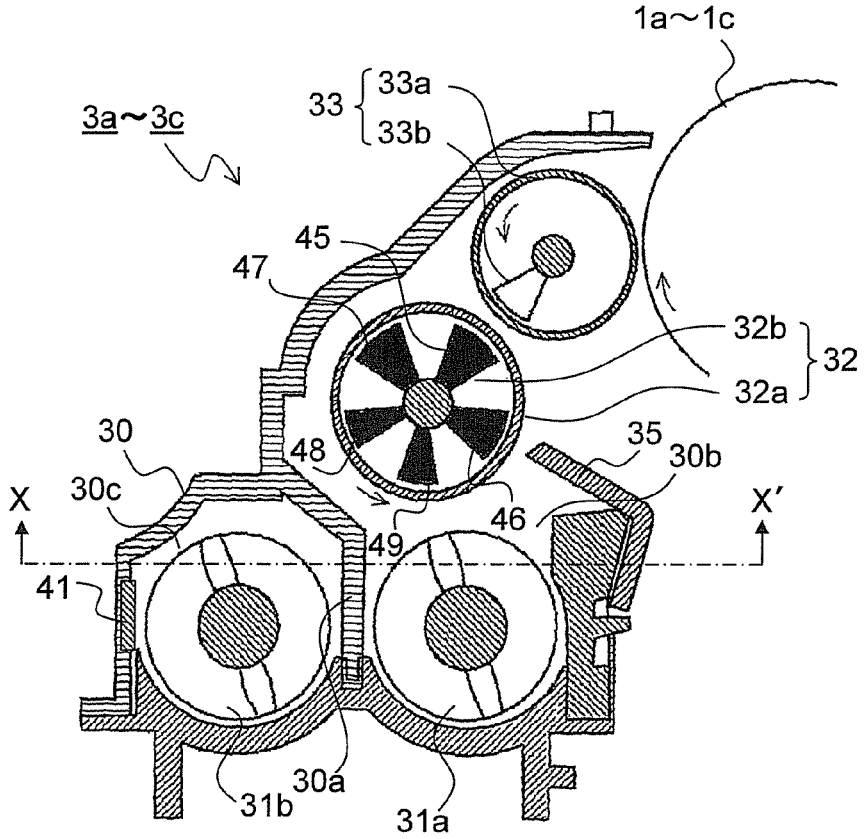
FIG. 4 is a side sectional view of developing devices 3*a* to 3*c* incorporated in image forming sections Pa to Pc, respectively, in the image forming apparatus 100 of the first embodiment.

Next, detailed descriptions will be given of configurations of the developing devices 3*a* to 3*d*. FIG. 4 is a side sectional view of the developing devices 3*a* to 3*c*. As shown in FIG. 4, the developing devices 3*a* to 3*c* are each provided with a developing container 30 in which the developer is accommodated, and the developing container 30 is separated by a partition 30*a* into a supply conveyance chamber 30*b* and an agitation conveyance chamber 30*c*. In the supply conveyance chamber 30*b* and the agitation conveyance chamber 30*c*, there are rotatably disposed a supply conveyance screw 31*a* and an agitation conveyance screw 31*b*, respectively, for charging by mixing and agitating the toner (positively-charged toner) and the carrier included in each of the developers respectively supplied from the containers 4*a* to 4*c* (refer to FIG. 1).

Then, the developer is conveyed in an axial direction (a direction perpendicular to the plane of FIG. 4), while being agitated, by the supply conveyance screw 31*a* and the agitation conveyance screw 31*b*, and the developer circulates in the supply conveyance chamber 30*b* and the agitation conveyance chamber 30*c* via developer passages 40*a* and 40*b* (see FIG. 6) respectively formed at two end portions of the partition 30*a*. That is, the supply conveyance chamber 30*b*, the agitation conveyance chamber 30*c*, and the developer passages 40*a* and 40*b* together form a developer circulation path inside the developing container 30.

The developing container 30 extends obliquely upward to the right in FIG. 4; inside the developing container 30, the magnetic roller 32 is located above the supply conveyance screw 31*a*, and the developing roller 33 is located obliquely upward to the right of, and facing, the magnetic roller 32. Further, the developing roller 33 faces a corresponding one of the photosensitive drums 1*a* to 1*c* on an opening side (right side of FIG. 4) of the developing container 30, and the magnetic roller 32 and the developing roller 33 rotates about respective rotation shafts in a counterclockwise direction in FIG. 4.

Inside the agitation conveyance chamber 30*c*, there is provided a toner concentration sensor 41 facing the agitation conveyance screw 31. Used as the toner concentration sensor 41 is a magnetic permeability sensor for detecting a magnetic permeability of the two-component developer including the toner and the magnetic carrier inside the developing container 30. Here, the toner concentration represents a ratio (T/C) of the toner with respect to the magnetic carrier in the developer, and in the present embodiment, the toner concentration sensor 41 is configured to detect the magnetic permeability of the developer and output a voltage value corresponding to a result of its detection to a control section (not shown), which will be described later, and the toner concentration is determined by the control section based on an output value obtained from the toner concentration sensor 41. The control section transmits to a supply motor a control signal corresponding to the determined toner concentration, and supplies the developing container 30 with a predetermined amount of developer through a developer supply port 30*d* (see FIG. 6).

The magnetic roller 32 includes a non-magnetic rotation sleeve 32*a* and a stationary magnet body 32*b* disposed inside the rotation sleeve 32*a* and having a plurality of magnetic poles (here, 5 poles). In the present embodiment, the stationary magnet body 32*b* includes five poles, namely, a main pole 45, a regulation pole (ear cutting magnetic pole) 46, a conveying pole 47, an exfoliation pole 48, and a scooping pole 49.

The developing roller 33 includes a cylindrical developing sleeve 33*a*, and a developing roller-side magnetic pole 33*b* fixed inside the developing sleeve 33*a*, the developing roller 33 located facing the magnetic roller 33 with a predetermined gap therebetween at the facing position (opposing position). The developing roller-side magnetic pole 33*b* has a polarity different from that of the opposing magnetic pole (main pole) 45 of the stationary magnetic body 32*b*.

Further, an ear cutting blade 35 is attached to the developing container 30 along a longitudinal direction (direction perpendicular to the plane of FIG. 4) of the magnetic roller 32, and the ear cutting blade 35 is positioned upstream from the opposing position where the developing roller 33 and the magnetic roller 32 face each other, in a rotational direction of the magnetic roller 32 (counterclockwise direction in FIG. 4). Further, a slight clearance (gap) is formed between an edge portion of the ear cutting blade 35 and a surface of the magnetic roller 32.

A direct current voltage (hereinafter, referred to as Vslv (DC)) and an alternating current voltage (hereinafter, referred to as Vslv (AC)) are applied to the developing roller 33, while a direct current voltage (hereinafter, referred to as Vmag (DC)) and an alternating current voltage (hereinafter, referred to as Vmag (AC)) are applied to the magnetic roller 32.

As has been described above, the toner is charged while the developer is circulating inside the developing container 30 by being conveyed, while being agitated, by the supply conveyance screw 31*a* and the agitation conveyance screw 31*b*, and the developer is conveyed to the magnetic roller 32 by the supply conveyance screw 31*a*. Then, a magnetic brush is formed on the magnetic roller 32 with the carrier and toner particles adhering to each other, and the magnetic brush on the magnetic roller 32 has its layer thickness regulated by the ear cutting blade 35. Thereafter, the magnetic brush is conveyed to an opposing portion where the magnetic roller 32 and the developing roller 33 face each other, and a thin toner layer is formed on the developing roller 33 based on a potential difference ΔV between Vmag (DC) applied to the magnetic roller 32 and Vslv (DC) applied to the developing roller 33, and a magnetic field.

Although the toner layer thickness on the developing roller 33 changes with, for example, resistance of the developer, the rotation speed difference between the magnetic roller 32 and the developing roller 33, the toner layer thickness is able to be controlled by the potential difference ΔV. The larger the potential difference ΔV is made, the thicker the toner layer becomes on the developing roller 33, while the smaller the potential difference ΔV is made, the thinner the toner layer becomes on the developing roller 33. An appropriate range of the potential difference ΔV for development is typically on the order of 100 V to 350 V.

The thin toner layer formed on the developing roller 33 by the magnetic brush is conveyed by rotation of the developing roller 33 to the opposing portion where the corresponding one of the photosensitive drums 1*a* to 1*c* faces the developing roller 33. Since Vslv (DC) and Vslv (AC) are applied to the developing roller 33, the toner is caused to fly from the developing roller 33 to the corresponding one of the photosensitive drums 1*a* to 1*c* by the potential difference with respect to the surface potential of the corresponding one of the photosensitive drums 1*a* to 1*c*, and thereby an electrostatic latent image is formed on each of the photosensitive drums 1*a* to 1*c*.

The toner left without being used for development is again conveyed by the rotation of the developing roller 33 at the opposing portion where the developing roller 33 and the magnetic roller 32 face each other, and is recovered by the magnetic brush on the magnetic roller 32. Subsequently, after being exfoliated from the magnetic roller 32 at portions of a same polarity (the exfoliation pole 48, the scooping pole 49) of the stationary magnet body 32*b*, the magnetic brush is brought back into the two-component developer circulating in the supply conveyance chamber 30*b* and the agitation conveyance chamber 30*c*. Then, as a two-component developer electrically charged uniformly and having a proper toner concentration, the two-component developer forms a magnetic brush on the magnetic roller 32 to be conveyed to the ear cutting blade 35.

Figure 5:
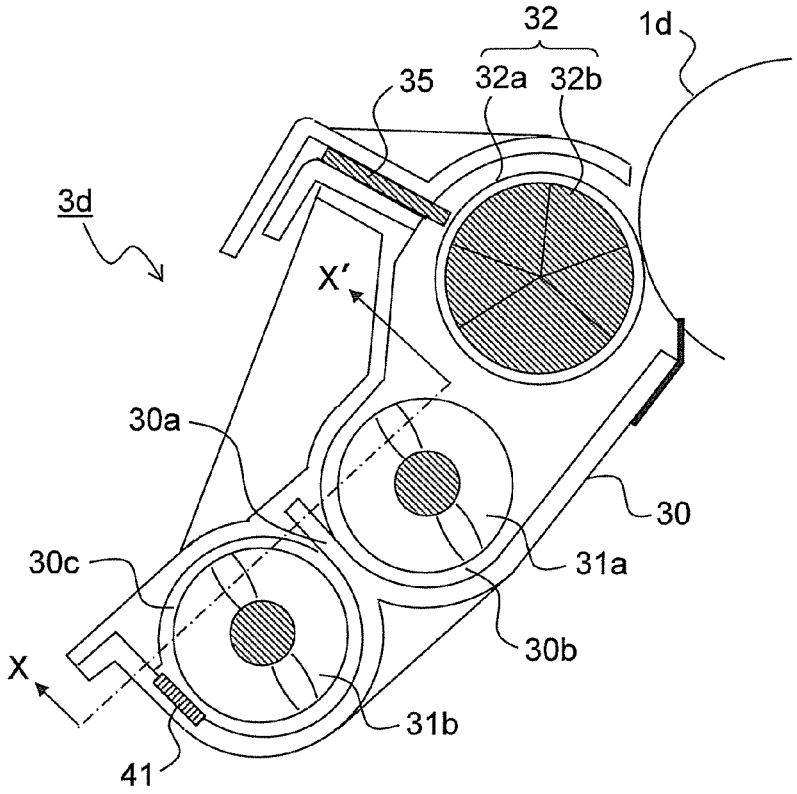
FIG. 5 is a side sectional view of a developing device 3*d* incorporated in the image forming section Pd in the image forming apparatus 100 of the first embodiment.

FIG. 5 is a side sectional view of the developing device 3*d*. As shown in FIG. 3, the developing container 30 where the developer is accommodated is separated by the partition 30*a* into the supply conveyance chamber 30*b* and the agitation conveyance chamber 30*c*. And, the supply conveyance screw 31*a* is disposed in the supply conveyance chamber 30*b*, and the agitation conveyance screw 31*b* is disposed in the agitation conveyance chamber 30*c*. The developer supply port 30*d* (see FIG. 6) is provided in an upper portion of the developing container 30, and the developer accommodated in the container 4*d* (see FIG. 1) is supplied according to the detection result of the toner concentration sensor 41 (not shown) that detects the amount of the toner in the developing container 30.

The supply conveyance screw 31*a* and the agitation conveyance screw 31*b* each have a configuration in which a spiral blade is provided on the circumferential surface of a shaft, and are rotatably supported to be parallel to each other in the developing container 30. The partition 30*a* does not exist at both and portions in a longitudinal direction (direction perpendicular to the plane of FIG. 5) of the developing container 30, the longitudinal direction being an axial direction of the supply conveyance screw 31*a* and the agitation conveyance screw 31*b*, but instead, developer passages 40*a* and 40*b* (see FIG. 6) are formed. The developer passages 40*a* and 40*b* allows delivery of the developer between the supply conveyance screw 31*a* and the agitation conveyance screw 31*b*, and the agitation conveyance screw 31*b* conveys toner existing in the agitation conveyance chamber 30*c*, while agitating the toner, into the supply conveying chamber 30*b*, and the supply conveyance screw 30*a* supplies the developer that has been conveyed into the supply conveyance chamber 30*b*, while agitating the developer, to the magnetic roller 32.

The magnetic roller 32 is rotatably supported in the developing container 30 to be parallel with the supply conveyance screw 31*a* and the agitation conveyance screw 31*b*. The magnetic roller 32 includes a non-magnetic, rotation sleeve 32*a* and a stationary magnet body 32*b* disposed inside the rotation sleeve 32*a* and having a plurality of magnetic poles (here, 5 poles). A developer is caused to adhere to (be carried on) the surface of the rotation sleeve 32*a* by the magnetism of the stationary magnet body 32*b*, and thereby a magnetic brush is formed. Part of the circumferential surface of the magnetic roller 32 is exposed from the developing container 30, and the magnetic roller 32 is disposed such that the exposed portion faces the photosensitive drum 1*d*.

The ear cutting blade 35 is formed such that its longitudinal length is greater than a maximum development width of the magnetic roller 32, and by being disposed a predetermined distance away from the magnetic roller 32, the ear cutting blade 35 regulates the amount of toner supplied to the photosensitive drum 1*d*. The distance between the magnetic roller 32 and the ear cutting blade 35 is set to be on the order of 0.1 mm to 2 mm. The material of the ear cutting blade 35 is, for example, magnetic or non-magnetic stainless steel (SUS).

The regulation pole (for example, N pole) of the stationary magnet body 32*b* faces the ear cutting blade 35, an opposite polarity (S pole) is induced at an edge of the ear cutting blade 35, and thus an attracting magnetic field is generated between the magnetic roller 32 and the ear cutting blade 35. By means of this magnetic field, a magnetic brush is formed between the ear cutting blade 35 and the magnetic roller 32. Then, when the magnetic roller 32 rotates clockwise in FIG. 5 to cause the magnetic brush to move to a position facing the photosensitive drum 1*d*, the magnetic brush touches the surface of the photosensitive drum 1*d* to form a toner image.

Figure 6:
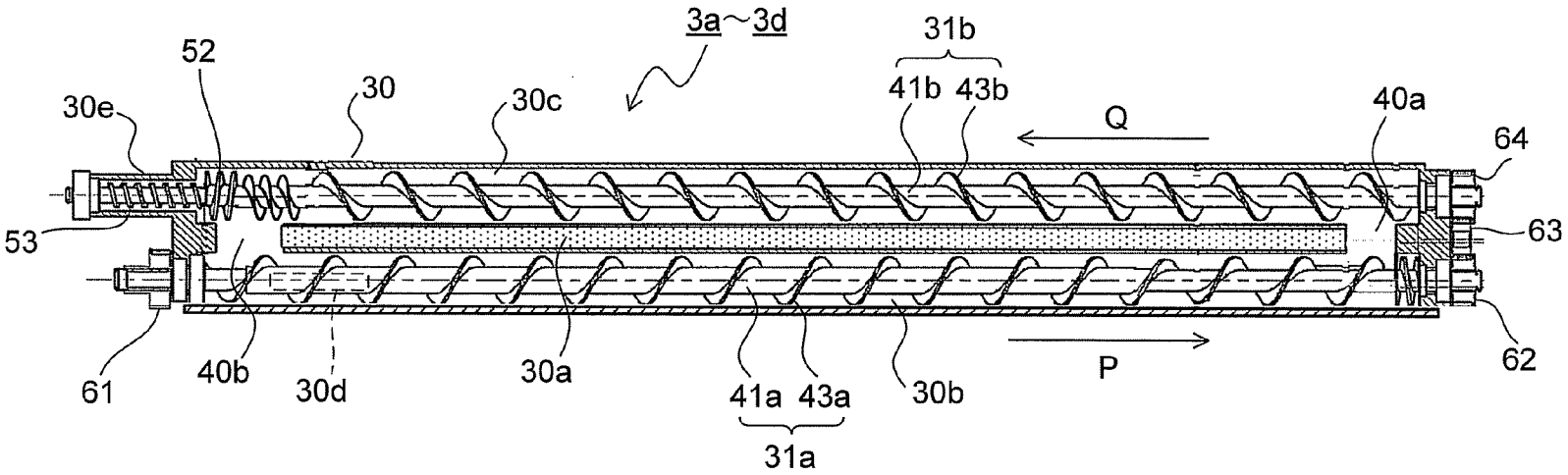
FIG. 6 is a plan sectional view showing a configuration of agitating portions of the developing devices 3*a* to 3*d;*

Next, a detailed description will be given of an agitating portion of the developing devices 3*a* to 3*d*. The configuration of the agitating portion is basically the same for the developing devices 3*a* to 3*c* shown in FIG. 4 and the developing device 3*d* shown in FIG. 5, and thus the following description of the agitating portion is common to the developing devices 3*a* to 3*d*. FIG. 6 is a plan sectional view (sectional view as seen from the arrow direction of X X' line of FIG. 4 and FIG. 5) showing the agitating portion of the developing devices 3*a* to 3*d*.

As mentioned above, by means of the partition 30*a*, the supply conveyance chamber 30*b*, the agitation conveyance chamber 30*c*, and the developer passages 40*a* and 40*b* are formed in the developing container 30, and in addition, the developer supply port 30*d* and a developer discharge portion 30*e* are formed in the developing container 30. It should be noted that, in the supply conveyance chamber 30*b*, the left side in FIG. 6 is the upstream side and the right side in FIG. 6 is the downstream side in the supply conveyance chamber 30*b*, while the right side in FIG. 6 is the upstream side and the left side in FIG. 6 is the downstream side in the agitation conveyance chamber 30*c*. Thus, the developer passages 40*a* and 40*b* are referred to with upstream-side and downstream-side, respectively, with respect to the agitation conveyance chamber 30*c*.

The partition 30*a* extends in the longitudinal direction of the developing container 30 to separate the supply conveyance chamber 30*b* and the agitation conveyance chamber 30*c* from each other to be disposed side by side. The right end portion of the partition 30*a* in the longitudinal direction, together with an interior wall portion of the developing container 30, forms the upstream-side developer passage 40*a*, and on the other hand, the left end portion of the partition 30*a* in the longitudinal direction, together with the interior wall portion of the developing container 30, forms the downstream-side developer passage 40*b*. This allows the developer to circulate through inside the supply conveyance chamber 30*b*, the developer passage 40*a*, the agitation conveyance chamber 30*c*, and the developer passage 40*b*.

The developer supply port 30*d* is an opening for supplying anew developer into the developing container 30 from a corresponding one of the containers 4*a* to 4*d* (see FIG. 1) provided in the upper portion of the developing container 30, and the developer supply port 30*d* is disposed on the upstream side (left side in FIG. 6) of the supply conveyance chamber 30*b*.

The developer discharge portion 30*e* is an opening for discharging surplus part of the developer in the supply conveyance chamber 30*b* and the agitation conveyance chamber 30*c*, and the developer discharge portion 30*e* is provided downstream from the agitation conveyance chamber 30*c* to be continuously provided in the longitudinal direction of the agitation conveyance chamber 30*c*.

The supply conveyance chamber 30*b* has the supply conveyance screw 31*a* disposed therein, and the agitation conveyance chamber 30*c* has the agitation conveyance screw 31*b* disposed therein. The supply conveyance screw 31*a* has a rotation shaft 41*a* and a spiral blade 43*a* that is integral with the rotation shaft 41*a* and spirally formed in the axial direction of the rotation shaft 41*a* at a constant pitch. The agitation conveyance screw 31*b* has a rotation shaft 41*b* and a spiral blade 43*b* that is integral with the rotation shaft 41*b* and spirally formed in the axial direction of the rotation shaft 41*b* at a constant pitch. The spiral blade 43*b* of the agitation conveyance screw 31*b* is provided at the same pitch as, and reversely oriented (reversely phased) with respect to, the spiral blade 43*a* of the supply conveyance screw 31*a*. The rotation shafts 41*a* and 41*b* of the supply conveyance screw 31*a* and the agitation conveyance screw 31*b*, respectively, are rotatably supported on wall portions of the developing container 30 at the both end sides in the longitudinal direction.

Further, the rotation shaft 41*b* of the agitation conveyance screw 31*b* has, in addition to the spiral blade 43*b*, a regulation portion 52 and a discharge blade 53 which are formed integral therewith.

The regulation portion 52 is provided to stop the developer conveyed to the downstream side in the agitation conveyance chamber 30*c*, and to convey the developer to the developer discharge portion 30*e* when the amount of the developer exceeds a predetermined value. The regulation portion 52 is a spiral blade that is reversely oriented (reversely phased) with respect to the spiral blade 43*b*, that has substantially the same external diameter as the spiral blade 43*b*, and that is formed at a smaller pitch than the spiral blade 43*b*. Between the interior wall portion of the developing container 30 and an outer circumferential edge of the regulation portion 52, a gap of a predetermined size is formed. Through this gap, the surplus part of the developer is discharged to the developer discharge portion 30*e*.

The rotation shaft 41*b* extends to inside the developer discharge portion 30*e*. The portion of the rotation shaft 41*b* existing inside the developer discharge portion 30*e* is provided with a discharge blade 53. The discharge blade 53 is formed as a spiral blade that is oriented to the same direction as the spiral blade 43*b*, that is disposed at a smaller pitch than the spiral blade 43*b*, and that has a smaller external diameter than the spiral blade 43*b*. Thus, when the rotation shaft 41*b* rotates, the discharge blade 53 rotates as well, such that the surplus part of the developer that has been conveyed over the regulation portion 52 into the developer discharge portion 30*e* is further conveyed to the left side in FIG. 6, to be discharged to outside the developing container 30. The discharge blade 53, the regulation portion 52, and the spiral blade 43*b* are formed of a synthetic resin to be integral with the rotation shaft 41*b*.

At an exterior wall of the developing container 30, there are disposed gears 61 to 64. The gears 61 and 62 are firmly fixed to the rotation shaft 41*a*, the gear 64 is firmly fixed to the rotation shaft 41*b*, and the gear 63 is rotatably held in the developing container 30 and meshes with the gears 62 and 64.

In a case of development performed without new supply of developer, when the gear 61 is driven to rotate by a driving source such as a motor, the supply conveyance screw 31*a* rotates to convey the developer existing inside the supply conveyance chamber 30*b* in a direction indicated by arrow P, through the developer passage 40*a*, into the agitation conveyance chamber 30*c*. Furthermore, the driving force of the supply conveyance screw 31*a* is transmitted to the agitation conveyance screw 31*b* via the gears 62 to 64, and when the agitation conveyance screw 31*b* rotates, the developer existing in the agitation conveyance chamber 30*c* is conveyed in a direction indicated by arrow Q. Thus, the developer is conveyed from the supply conveyance chamber 30*b* through the upstream-side developer passage 40*a* into the agitation conveyance chamber 30*c*, drastically changing its heap height, and is conveyed, without moving over the regulation portion 52, through the downstream-side developer passage 40*b*, into the supply conveyance chamber 30*b*.

In this way, the developer is agitated while circulating from the supply conveyance chamber 30*b*, to the developer passage 40*a*, the agitation conveyance chamber 30*c*, and the developer passage 40*b*, and the thus agitated developer is supplied to the magnetic roller 32.

Next, a description will be given of a case where new developer is added from the developer supply port 30*d*. When the toner is consumed in development, the developer including the toner and the carrier is added from the developer supply port 30*d* into the supply conveyance chamber 30*b*.

The added developer is, in the same manner as in development, conveyed by the supply conveyance screw 31*a* in the direction indicated by arrow P inside the supply conveyance chamber 30*b*, and thereafter, the added developer is conveyed through the upstream-side developer passage 40*a* into the agitation conveyance chamber 30*c*. Furthermore, the developer existing inside the agitation conveyance chamber 30*c* is conveyed by the agitation conveyance screw 31*b* in the direction indicated by arrow Q. When the regulation portion 52 rotates along with the rotation of the agitation conveyance screw 31*b*, the restriction portion 52 gives the developer a transporting force in a direction opposite to the direction (indicated by arrow Q) in which the developer is transported by the spiral blade 43*b*. The developer is stopped by the regulation portion 52 into a high heap, and surplus part of the developer moves over the regulation portion 52 to be discharged via the developer discharge portion 30*e* to the outside of the developing container 30.

Figure 7:
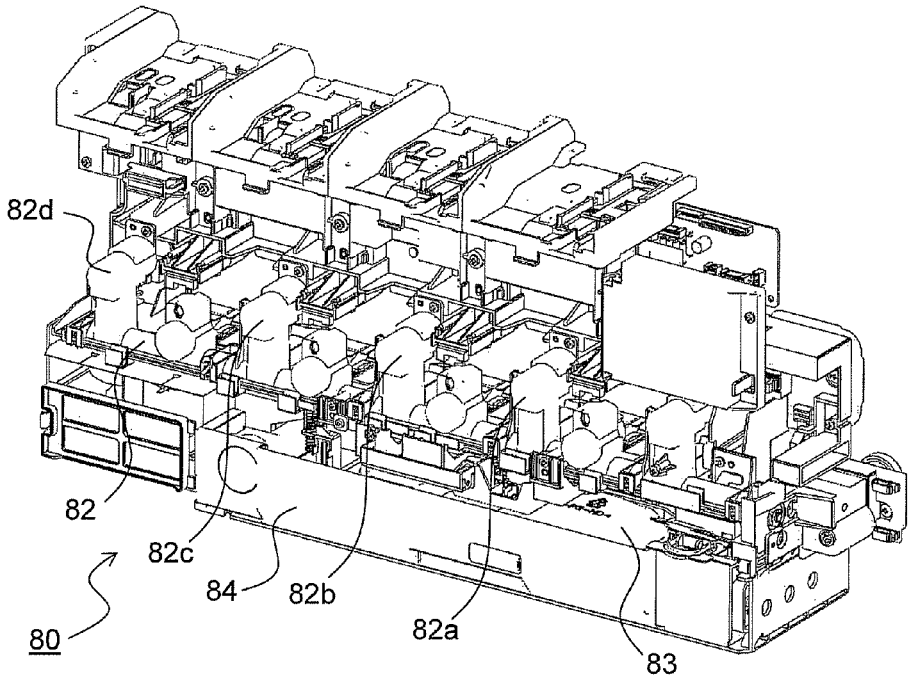
FIG. 7 is a perspective view of a developer recovering mechanism 80 in the image forming apparatus 100 of the first embodiment.

FIG. 7 is a perspective view of a developer recovering mechanism 80 in the image forming apparatus 100 of the first embodiment. Note that the developing devices 3*a* to 3*d* are not illustrated in FIG. 7. The developer recovering mechanism 80 has a conveyance pipe 82 inside which a conveyance screw (not shown) is disposed, and a recovery container 83 for storing the developer conveyed thereto through the conveyance pipe 82. The recovery container 83 is accommodated in a drawable tray 84. The conveyance pipe 82 has connection portions 82*a* to 82*d* connected to the developer discharge portions 30*e* (see FIG. 6) of the developing devices 3*a* to 3*d*, respectively.

In the present embodiment, when the developing devices 3*a* to 3*c* disposed in the magenta, cyan, and yellow image forming sections Pa to Pc shown in FIG. 4 and the developing device 3*d* disposed in the black image forming section Pd shown in FIG. 5 are installed in the image forming apparatus 100, respective positional relationships between the rotation shafts of the photosensitive drums 1*a* to 1*d* and the rotation shafts 41*b* of the agitation conveyance screws 31*b* of the developing devices 3*a* to 3*d* corresponding to the photosensitive drums 1*a* to 1*d*, respectively, are all the same.

Figure 8:
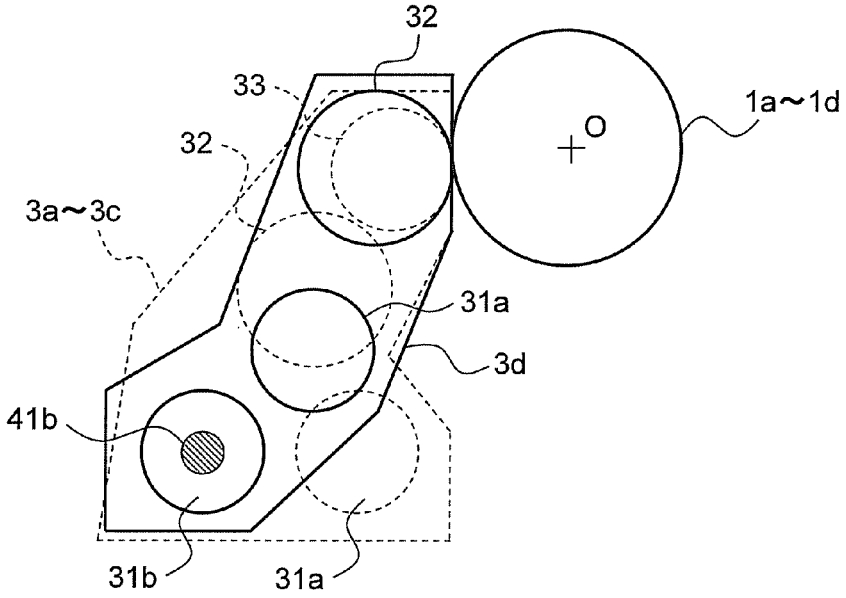
FIG. 8 is a diagram showing a positional relationship between rotation shafts O of the photosensitive drums 1*a* to 1*d* and the agitation conveyance screws 31*b* of the developing devices 3*a* to 3*d*, respectively, in the image forming apparatus 100 of the first embodiment.

Specifically, as shown in FIG. 8, when the developing rollers 33 of the developing devices 3*a* to 3*c* and the magnetic roller 32 of the developing device 3*d* are disposed at respective predetermined positions facing the photosensitive drums 1*a* to 1*d*, the rotation shafts 41*b* of the agitation conveyance screws 31*b* of the developing devices 3*a* to 3*d* are disposed in the same direction (lower left direction in FIG. 8) as seen from, and at the same distance from, rotation shafts O of the photosensitive drums 1*a* to 1*d*, respectively.

As shown in FIG. 6, the developer discharge portion 30*e* is provided on an extension of the rotation shaft 41*b* of the agitation conveyance screw 31*b*. That is, the developer discharge portions 30*e* of the developing devices 3*a* to 3*d* are disposed in the same positional relationship with respect to the photosensitive drums 1*a* to 1*d*, respectively. Furthermore, the positional relationships between the rotation shafts O of the photosensitive drums 1*a* to 1*d* disposed in the image forming sections Pa to Pd and the connection portions 82*a* to 82*d* of the developer recovery mechanism 80 corresponding to the photosensitive drums 1*a* to 1*d*, respectively, are all the same in the image forming sections Pa to Pd.

With this configuration, in a case, for example, where specifications of the image forming apparatus 100 is such that a black image is formed in the image forming section Pa, by incorporating the developing device 3*d* employing the first developing method in the image forming section Pa, it is possible to securely connect the developer discharge portion 30*e* of the developing device 3*d* to the connecting portion 82*a* of the developer recovery mechanism 80. Likewise, when it is desired to change the order of the image forming sections forming cyan, magenta, and yellow images, by merely changing the order of the developing devices 3*a* to 3*c*, it is possible to securely connect the developer discharge portions 30*e* of the developing devices 3*a* to 3*c* to the connecting portions 82*b* to 82*d*, respectively, of the developer recovery mechanism 80.

Thus, the developing device 3*d* employing the first developing method and the developing devices 3*a* to 3*c* employing the second developing method can be incorporated freely in any of the image forming sections Pa to Pd, and this helps enhance the degree of freedom in design and layout of the image forming apparatus 100. Moreover, it is possible to achieve common specifications of the developing devices 3*a* to 3*d* and the developer recovering mechanism 80, and this helps reduce the number of components and achieve simple management of components. Furthermore, it is possible to achieve a common assembling process, and this helps reduce production cost.

It should be noted that, although, in the present embodiment, where the developer discharge portion 30*e* is disposed on the same shaft with the agitation conveyance screw 31*b*, the rotation shafts of the photosensitive drums 1*a* to 1*d* and the rotation shafts 41*b* of the agitation conveyance screws 31*b* of the developing devices 3*a* to 3*d* corresponding to the photosensitive drums 1*a* to 1*d*, respectively, are disposed to be in the same positional relationship, it is also possible to dispose the developer discharge portion 30*e* and the supply conveyance screw 31*a* on the same shaft. In this case, respective positional relationships between the rotation shafts O of the photosensitive drums 1*a* to 1*d* and the rotation shafts 41*a* of the supply conveyance screws 31*a* of the developing devices 3*a* to 3*d* corresponding to the photosensitive drums 1*a* to 1*d*, respectively, are all the same.

Figure 9:
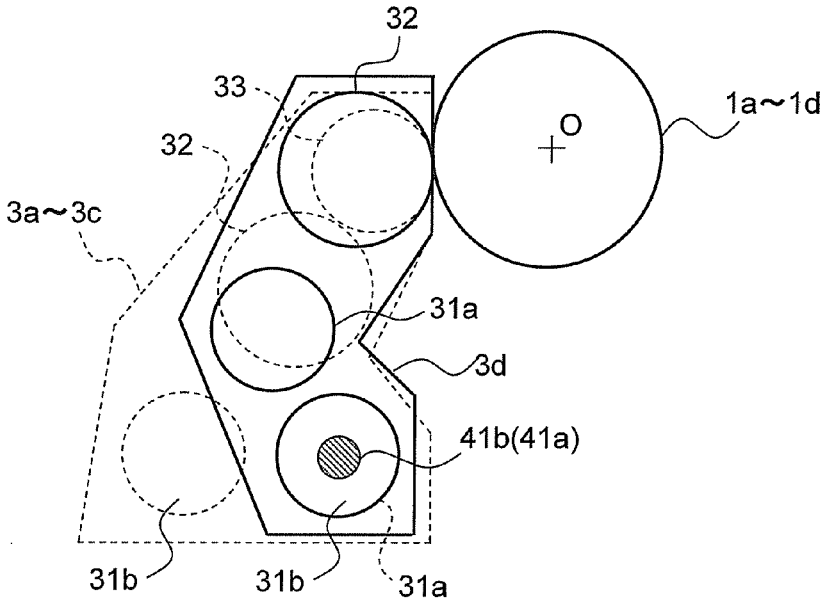
FIG. 9 is a diagram showing a positional relationship between the rotation shafts O of the photosensitive drums 1*a* to 1*d* and the supply conveyance screws 31*a* of the developing devices 3*a* to 3*c* and the agitation conveyance screw 31*b* of the developing device 3*d* in the image forming apparatus 100 of the first embodiment.

Alternatively, the developer discharge portions 30*e* of the developing devices 3*a* to 3*c* may each be disposed on the same shaft with the supply conveyance screw 31*a*, and the developer discharge portion 30*e* of the developing device 3*d* may be disposed on the same shaft as the agitation conveyance screw 31*b*. In this case, as shown in FIG. 9, positional relationships between the rotation shafts O of the photosensitive drums 1*a* to 1*c* and the rotation shafts 41*a* of the supply conveyance screws 31*a* of the developing devices 3*a* to 3*c* corresponding to the photosensitive drums 1*a* to 1*c*, respectively, and a positional relationship between the rotation shaft O of the photosensitive drum ld and the rotation shaft 41*b* of the agitation conveyance screw 31*b* of the developing device 3*d* corresponding to the photosensitive drum 1*d* are the same.

That is, the rotation shafts 41*b* or the rotation shafts 41*a* of the agitation conveyance screws 31*b* or the supply conveyance screws 31*a*, respectively, of the developing devices 3*a* to 3*d* where the developer discharge portions 30*e* are provided are located in the same direction as seen from, and at the same distance from, the rotation shafts O of the photosensitive drums 1*a* to 1*d*.

Figure 10:
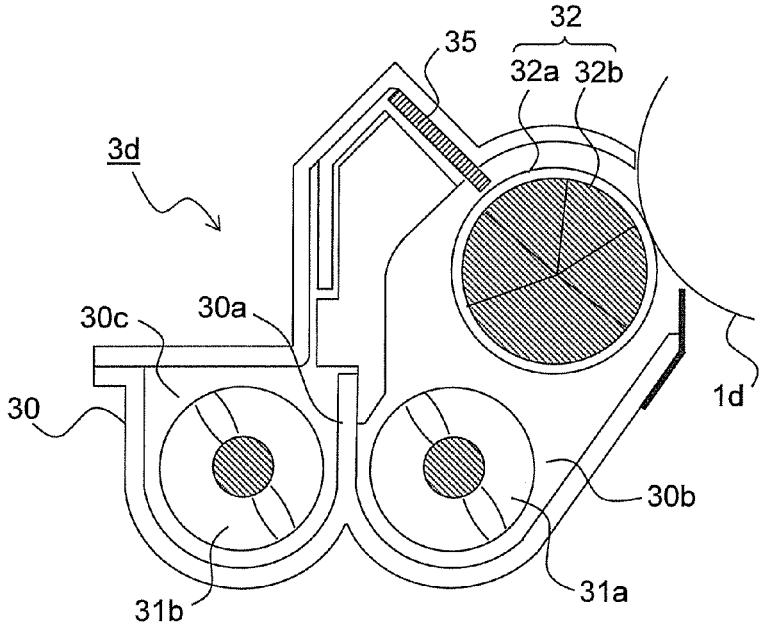
FIG. 10 is a side sectional view of the developing device 3*d* incorporated in an image forming section Pd in an image forming apparatus 100 according to a second embodiment of the present disclosure.

FIG. 10 is a side sectional view of the developing device 3*d* employed in the image forming device 100 of a second embodiment of this disclosure. In the developing device 3*d* employed in the present embodiment, like in the developing devices 3*a* to 3*c* (see FIG. 4), the supply conveyance chamber 30*b* and the agitation conveyance chamber 30*c* are horizontally disposed inside the developing container 30. Also, the supply conveyance screw 31*a* inside the supply conveyance chamber 30*b* and the agitation conveyance screw 31*b* inside the agitation conveyance chamber 30*c* are also horizontally disposed. Note that the other portions of the developing device 3*d* and the developing devices 3*a* to 3*c* are configured in the same manner as those of the first embodiment. Further, the agitating portions of the developing devices 3*a* to 3*d* and the developer recovery mechanism 80 are also configured in the same manner as those of the first embodiment, and thus, descriptions thereof will be omitted.

In the present embodiment, when the developing devices 3*a* to 3*c* shown in FIG. 4 and the developing device 3*d* shown in FIG. 10 are placed in the image forming apparatus 100, respective positional relationships between the rotation shafts O of the photosensitive drums 1*a* to 1*d* and the rotation shafts 41*a* of the supply conveyance screws 31*a* and the rotation shafts 41*b* of the agitation conveyance screws 31*b* of the developing devices 3*a* to 3*d* corresponding to the photosensitive drums 1*a* to 1*d*, respectively, are all the same.

Figure 11:
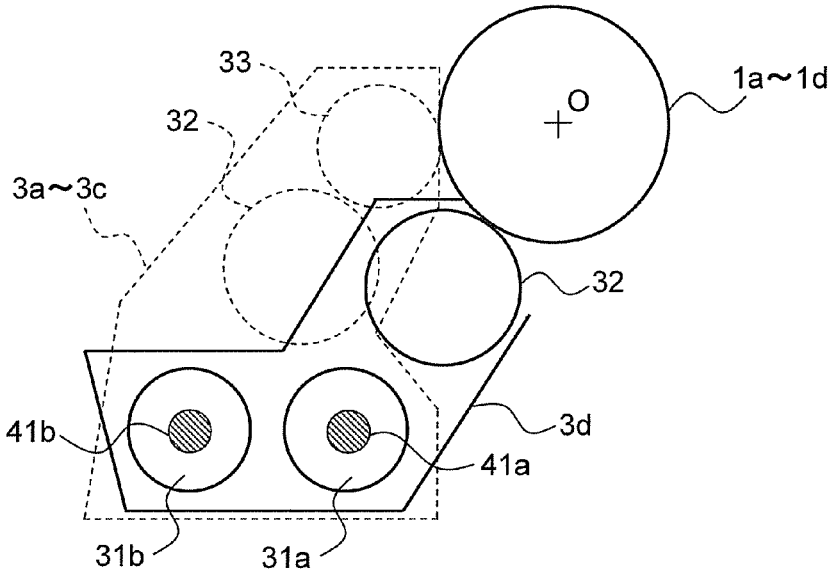
FIG. 11 is a diagram showing a positional relationship of the supply conveyance screws 31*a* and the agitation conveyance screws 31*b* of the developing devices 3*a* to 3*d* as seen from the rotation shafts O of the photosensitive drums 1*a* to 1*d*, respectively, in the image forming apparatus 100 of the second embodiment.

Specifically, as shown in FIG. 11, when the developing rollers 33 of the developing devices 3*a* to 3*c* and the magnetic roller 32 of the developing device 3*d* are disposed at respective predetermined positions facing the photosensitive drums 1*a* to 1*d*, the rotation shafts 41*a* of the supply conveyance screws 31*a* and the rotation shafts 41*b* of the agitation conveyance screws 31*b* of the developing devices 3*a* to 3*d* are disposed in the same direction (lower left direction in FIG. 11) as seen from, and at the same distance from, the rotation shafts O of the photosensitive drums 1*a* to 1*d*, respectively.

Further, as shown in FIG. 6, the developer discharge portion 30*e* is provided on an extension of the rotation shaft 41*b* of the agitation conveyance screw 31*b*. That is, the developer discharge portions 30*e* of the developing devices 3*a* to 3*d* are disposed in the same positional relationship with respect to the photosensitive drums 1*a* to 1*d*, respectively.

With this configuration, in a case, for example, where specifications of the image forming apparatus 100 are such that a black image is formed in the image forming section Pa, by installing the developing device 3*d* employing the first developing method in the image forming section Pa, it is possible to securely connect the developer discharge portion 30*e* of the developing device 3*d* to the connecting portion 82*a* of the developer recovery mechanism 80.

Thus, like in the first embodiment, the developing device 3*d* employing the first developing method and the developing devices 3*a* to 3*c* employing the second developing method can be installed freely in any of the image forming sections Pa to Pd, and this helps enhance the degree of freedom in design and layout of the image forming apparatus 100. Moreover, it is possible to achieve common specifications of the developing devices 3*a* to 3*d* and the developer recovering mechanism 80, and this helps reduce the number of components and achieve simple management of components. Furthermore, it is possible to achieve a common assembling process, and this helps reduce production cost.

Moreover, in the present embodiment, positional relationships between the rotation shafts 41*a* of the supply conveyance screws 31*a* of the developing devices 3*a* to 3*d* and the photosensitive drums 1*a* to 1*d*, respectively, are all the same. Thus, in a case also where the developer discharge portions 30*e* of the developing devices 3*a* to 3*d* are each provided on an extension of the rotation shaft 41*a* of the corresponding supply conveyance screw 31*a*, when installation positions of the developing devices 3*a* to 3*d* are changed, the developer discharge portions 30*e* of the developing devices 3*a* to 3*d* can be securely connected to the connection portions 82*a* to 82*d* of the developer recovery mechanism 80.

It should be understood that the present disclosure is not limited to the above embodiments, and various modifications are possible within the scope of the present disclosure. For example, the present disclosure is applicable not only to the color printer as shown in FIG. 1 but also to other color image forming apparatuses where developing devices employing first and second developing methods are co-resident, such as a color copier and a color multi-functional machine (that has functions of a copier, a facsimile, a scanner, and the like, and is referred to also as a multi-function peripheral (MFP)).

The present disclosure is applicable not only to color image forming apparatuses provided with a plurality of image forming sections but also to monochrome image forming apparatuses provided only with a black image forming section, such as a monochrome printer, a monochrome copier, and a monochrome digital multi-functional machine. With such a monochrome image forming apparatus as well, it is possible to selectively use two kinds of development methods according to a user's with a configuration where developing devices employing first and second developing methods are installable with compatibility.

The present disclosure is applicable to an image forming apparatus capable of compatibly incorporating a plurality of developing devices employing different developing methods. Use of the present disclosure makes it possible to achieve common specifications of the developing devices and the developer recovering mechanism, and thus to freely install two kinds of developing devices provided with a developer recovery mechanism and employing different developing methods; thus, it is possible to provide an image forming apparatus capable of reducing the number of components and simplifying the management of components.

What is claimed is:

1. An image forming apparatus, comprising:

an image carrier on which an electrostatic latent image is formed;

a developing device provided corresponding to the image carrier, the developing device including:

a developing container for accommodating a two-component developer including a magnetic carrier and toner;

a developer carrier rotatably supported in the developing container;

an agitation member that agitates and conveys the developer in the developing container;

a supply member that agitates and conveys the developer received from the agitation member and supplies the developer to the developer carrier;

a developer supply port through which the developer is supplied into the developing container; and a developer discharge portion that discharges a surplus part of the developer out of the developing container, the developing device developing the electrostatic latent image formed on the image carrier into a toner image, an image forming section including the image carrier and the developing device; and a developer recovery mechanism that has a connection portion connected to the developer discharge portion, and recovers the surplus part of the developer discharged from the developing device, the image forming section selectively incorporating either one of a first developing device employing a first developing method where toner is caused to adhere to a surface of the image carrier by means of a magnetic brush formed on the developer carrier and a second developing device having a toner carrier disposed between the developer carrier and the image carrier, and employing a second developing method where a toner layer is formed on a surface of the toner carrier by means of a magnetic brush formed on the developer carrier and toner is caused to adhere to the surface of the image carrier by means of the toner layer formed on the toner carrier, wherein in the first developing device and in the second developing device, the developer discharge portion is provided on a same shaft as either one of the agitation member and the supply member; and in the first developing device and the second developing device installed in the image forming section, a rotation shaft of whichever of the agitation member and the supply member of one of the first developing device and the second developing device is provided with the developer discharge portion is disposed in a same direction as seen from, and at a same distance from, the rotation shaft of the image carrier as the rotation shaft of whichever of the agitation member and the supply member of another one of the first developing device and the second developing device is provided with the developer discharge portion.

2. The image forming apparatus of claim 1, wherein in the first developing device and the second developing device, the developer discharge portion is provided on a same shaft as the agitation member; and in the first developing device and the second developing device installed in the image forming section, a rotation shaft of the agitation member of the first developing device is disposed in a same direction as seen from, and at a same distance from, the rotation shaft of the image carrier as a rotation shaft of the agitation member of the second developing device.

3. The image forming apparatus of claim 1, wherein, in the first developing device and the second developing device, the developer discharge portion is provided on a same shaft as the supply member; and in the first developing device and the second developing device installed in the image forming section, a rotation shaft of the supply member of the first developing device is disposed in a same direction as seen from, and at a same distance from, the rotation shaft of the image carrier as a rotation shaft of the supply member of the second developing device.

4. The image forming apparatus of claim 1, wherein the image forming section includes a plurality of image forming sections that all have a same positional relationship between a rotation shaft of the image carrier and the connection portion of the developer recovery mechanism corresponding to the image carrier.

5. An image forming apparatus, comprising:

an image carrier on which an electrostatic latent image is formed;

a developing device provided corresponding to the image carrier, the developing device including:

a developing container for accommodating a two-component developer including a magnetic carrier and toner;

a developer carrier rotatably supported in the developing container;

an agitation member that agitates and conveys the developer in the developing container;

a supply member that agitates and conveys the developer received from the agitation member and supplies the developer to the developer carrier;

a developer supply port through which the developer is supplied into the developing container; and a developer discharge portion that discharges surplus part of the developer out of the developing container, the developing device developing the electrostatic latent image formed on the image carrier into a toner image, an image forming section including the image carrier and the developing device; and a developer recovery mechanism that has a connection portion connected to the developer discharge portion, and recovers the surplus part of the developer discharged from the developing device, the image forming section selectively incorporating either one of a first developing device employing a first developing method where toner is caused to adhere to a surface of the image carrier by means of a magnetic brush formed on the developer carrier and a second developing device having a toner carrier disposed between the developer carrier and the image carrier, and employing a second developing method where a toner layer is formed on a surface of the toner carrier by means of a magnetic brush formed on the developer carrier and toner is caused to adhere to the surface of the image carrier by means of the toner layer formed on the toner carrier, wherein the developer discharge portion is provided on a same shaft as either one of the agitation member and the supply member in both of the first developing device and the second developing device; and in the first developing device and the second developing device installed in the image forming section, rotation shafts of the agitation member and the supply member of one of the first developing device and the second developing device are disposed in same directions as seen from, and at same distances from, the rotation shaft of the image carrier as rotation shafts of the agitation member and the supply member of another one of the first developing device and the second developing device.

6. The image forming apparatus of claim 5, wherein the image forming section includes a plurality of image forming sections that all have a same positional relationship between a rotation shaft of the image carrier and the connection portion of the developer recovery mechanism corresponding to the image carrier.

* * * * *